US009517903B2

(12) United States Patent
Yoshida et al.

(10) Patent No.: US 9,517,903 B2
(45) Date of Patent: Dec. 13, 2016

(54) PAPER FEEDING DEVICE AND IMAGE FORMING APPARATUS

(71) Applicants: Atsunori Yoshida, Kanagawa (JP); Joji Akiyama, Kanagawa (JP); Takashi Nakano, Kanagawa (JP); Yukihiko Natsui, Kanagawa (JP); Naoki Oikawa, Kanagawa (JP); Takashi Hirayama, Kanagawa (JP); Takuya Tomobe, Kanagawa (JP); Kazuhiko Okuyama, Kanagawa (JP)

(72) Inventors: Atsunori Yoshida, Kanagawa (JP); Joji Akiyama, Kanagawa (JP); Takashi Nakano, Kanagawa (JP); Yukihiko Natsui, Kanagawa (JP); Naoki Oikawa, Kanagawa (JP); Takashi Hirayama, Kanagawa (JP); Takuya Tomobe, Kanagawa (JP); Kazuhiko Okuyama, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/539,535

(22) Filed: Nov. 12, 2014

(65) Prior Publication Data

US 2015/0145199 A1 May 28, 2015

(30) Foreign Application Priority Data

Nov. 25, 2013 (JP) ..... 2013-242558

(51) Int. Cl.
*B65H 3/06* (2006.01)
*B65H 1/14* (2006.01)
(Continued)

(52) U.S. Cl.
CPC ..... *B65H 3/0669* (2013.01); *B65H 1/14* (2013.01); *B65H 1/266* (2013.01); *B65H 5/062* (2013.01);
(Continued)

(58) Field of Classification Search
CPC ..... B65H 1/08; B65H 1/266; B65H 3/06; B65H 3/0661; B65H 3/0669; B65H 3/0676; B65H 2402/515; B65H 2402/5152; B65H 2402/63; B65H 2403/43; B65H 2403/44; B65H 2403/48; B65H 2403/50; B65H 2403/54; B65H 2403/73; B65H 2403/731; B65H 2405/31; B65H 2405/313; B65H 2405/32; B65H 2405/324; B65H 2405/325; B65H 2513/412; B65H 2513/514; B65H 2601/122
See application file for complete search history.

(56) References Cited

U.S. PATENT DOCUMENTS 5,240,239 A * 8/1993 Kim ..... 271/10.11
5,497,986 A * 3/1996 Kudo ..... 271/122
(Continued)

FOREIGN PATENT DOCUMENTS

JP 2007-256497 10/2007

*Primary Examiner* — Ernesto Suarez
(74) *Attorney, Agent, or Firm* — Harness, Dickey & Pierce, P.L.C.

(57) ABSTRACT

A paper feeding device that includes, in a drive transmission mechanism to a paper feeding roller that delivers paper, a drive member provided on an apparatus body side as a member to transmit torque in a given direction for delivery of paper from a conveying motor to the paper feeding roller and a driven member provided on the paper feeding roller side. By relatively rotating the drive member and the driven member to form a coupling state of the members before an instruction to start the delivery of paper is output, the rotation of the paper feeding roller is started without a time lag when the instruction to start the delivery of paper is output.

17 Claims, 8 Drawing Sheets

(51) Int. Cl.

| | |
|---|---|
| ***B65H 1/26*** | (2006.01) |
| ***B65H 5/06*** | (2006.01) |
| ***B65H 7/02*** | (2006.01) |

(52) U.S. Cl.

CPC ..... *B65H 7/02* (2013.01); *B65H 2403/514* (2013.01); *B65H 2403/721* (2013.01); *B65H 2403/942* (2013.01); *B65H 2405/313* (2013.01); *B65H 2511/51* (2013.01); *B65H 2511/515* (2013.01); *B65H 2513/514* (2013.01)

(56) References Cited

U.S. PATENT DOCUMENTS

| | | | | |
|---|---|---|---|---|
| 6,298,778 | B1 * | 10/2001 | Onodera | B41L 21/02 101/116 |
| 6,578,840 | B1 * | 6/2003 | Kudo | 271/10.13 |
| 7,296,790 | B2 * | 11/2007 | Kim | 271/114 |
| 7,971,872 | B2 * | 7/2011 | Omura et al. | 271/162 |
| 8,348,258 | B2 * | 1/2013 | Kato et al. | 271/127 |
| 8,366,097 | B2 * | 2/2013 | Tu et al. | 271/10.13 |
| 8,422,904 | B2 * | 4/2013 | Maeda | G03G 15/5004 399/110 |
| 8,511,667 | B2 * | 8/2013 | Kuo | 271/10.13 |
| 2011/0076081 | A1 | 3/2011 | Hattori et al. | |
| 2011/0130260 | A1 | 6/2011 | Kikkawa et al. | |
| 2011/0245055 | A1 | 10/2011 | Saito et al. | |
| 2011/0301005 | A1 | 12/2011 | Hattori et al. | |
| 2011/0301008 | A1 | 12/2011 | Shibasaki et al. | |
| 2011/0301011 | A1 | 12/2011 | Ishikawa et al. | |
| 2012/0083400 | A1 | 4/2012 | Shibasaki et al. | |
| 2012/0086161 | A1 | 4/2012 | Nagasako et al. | |
| 2012/0115702 | A1 | 5/2012 | Ishikawa et al. | |
| 2012/0147388 | A1 | 6/2012 | Kojima et al. | |
| 2012/0157285 | A1 | 6/2012 | Aiba et al. | |
| 2014/0084531 | A1 | 3/2014 | Fukumoto et al. | |
| 2015/0008638 | A1 * | 1/2015 | Yamamoto | 271/256 |

* cited by examiner

PAPER FEEDING DEVICE AND IMAGE FORMING APPARATUS

CROSS-REFERENCE TO RELATED APPLICATIONS

The present application claims priority to and incorporates by reference the entire contents of Japanese Patent Application No. 2013-242558 filed in Japan on Nov. 25, 2013.

BACKGROUND OF THE INVENTION

1. Field of the Invention

The present invention relates to a paper feeding device and an image forming apparatus and, in particular, relates to drive transmission mechanisms for a paper feeding roller used in paper feeding operation.

2. Description of the Related Art

In an apparatus that can perform image forming by electro-photographic copying or by discharging ink droplets, a recording sheet is used as one of the recording media to bear images.

The recording sheet is delivered by a paper feeding roller from a placing portion of a paper feed tray detachably mounted in the image forming apparatus and is conveyed toward an image transferring position or a printing position.

While the paper feeding roller is rotated by a driving force that is transmitted from a driving source provided within the image forming apparatus, the paper feeding roller is not always used being coupled to a drive transmission mechanism from the driving source at all times.

That is, if the paper feed tray that is used to house paper is configured to be removable from the image forming apparatus when in paper replenishment or maintenance, a coupling mechanism that can select a state of drive transmission between the driving source side and the paper feeding roller side of the drive transmission mechanism may be used.

As for the coupling mechanism, known is a technology that uses a system similar to what is called a dog clutch that includes transmission rods or the like that fit in serrated teeth or recessed teeth which are provided on each shaft end of a rotating shaft on the paper feeding roller side and a transmission shaft on the driving source side and can mesh with each other.

As one example of the coupling mechanism in the foregoing system, the following describes a type that uses the fitting of recessed teeth and transmission rods, for example.

It is configured that the rotating shaft on the paper feeding roller side is provided with a fitting member having serrated teeth and being biased toward the shaft end side, while the transmission shaft on the driving source side is disposed with transmission rods that can fit in the recessed teeth of the serrated teeth along the radial direction (for example, Japanese Patent Application Laid-open No. 2007-256497).

In the above-described configuration, if the phase of the recessed teeth on the rotating shaft side agrees with that of the transmission rods on the transmission shaft side, the drive transmission to the paper feeding roller is enabled via the coupling mechanism.

In the conventional technology, when the meshing phases of the serrated teeth or recessed teeth and the transmission rods do not agree with each other, the transmission rods collide with the projecting teeth of the coupling mechanism. In such a case, after a paper feed tray is attached, required is an alignment operation of meshing phases in which both are fitted at the time the phases thereof agree with each other by either rotating the transmission rods or rotating the fitting teeth portion.

In particular, when the paper feed tray is attached again such as after it is pulled out for paper replenishment or maintenance and inspection, the meshing phases that were in agreement before being pulled out may be broken up and may be in a state of discrepancy, and thus it often requires the alignment operation of meshing phases.

However, in the case that a paper-feeding start command that instructs the paper feeding roller to start rotating is output at the time the paper feed tray is attached, if the above-described alignment operation is performed, a time lag is produced between the time of the paper feed command and the actual start time of the paper feeding roller.

When such a time lag is produced, extra time is required until a recording sheet on which an image is formed can be obtained.

In view of the above-mentioned conventional problems, there is a need to provide a paper feeding device and an image forming apparatus that are provided with the configuration in which, at the time the paper feed tray is set and a paper-feeding start command is output, a time lag between the time of the command and the starting time of the paper feeding roller can be prevented from being produced.

SUMMARY OF THE INVENTION

It is an object of the present invention to at least partially solve the problems in the conventional technology.

According to the present invention, there is provided a paper feeding device comprising: a paper feed tray that is movable with respect to an image forming apparatus body and houses a recording medium; a paper feeding roller that is rotated in a given direction for a delivery of the recording medium housed in the paper feed tray in a set state in which the paper feed tray occupies a given position with respect to the image forming apparatus body; and a drive transmission mechanism that performs drive transmission from a driving source to the paper feeding roller, wherein the drive transmission mechanism includes a drive member that is provided on the image forming apparatus body side and is driven to rotate by the driving source so as to rotate the paper feeding roller in the given direction, and a driven member that is provided on the paper feed tray side, forms a contacting state by contacting the drive member when the paper feed tray is set into the set state, and forms a coupling state in which the driven member rotates the paper feed roller in the given direction when the driven member is coupled to the drive member, and the coupling state is formed by relative rotation between the drive member and the driven member in the contacting state before a delivery instruction of the recording medium housed in the paper feed tray is output.

The present invention also provides an image forming apparatus that includes the above-mentioned paper feeding device.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a flowchart for explaining the operation concerning the setting of a fitting state of the fitting portion performed by the controller illustrated in FIG. 3 at the time of power-on;

FIG. 5 is a flowchart for explaining the operation concerning the setting of the fitting state of the fitting portion performed by the controller illustrated in FIG. 3 when a paper feed tray is reattached after power-on;

FIG. 6 is a flowchart for explaining the operation concerning the setting of the fitting state of the fitting portion performed by the controller illustrated in FIG. 3 when a paper placing portion is at an upper limit position after power-on;

DETAILED DESCRIPTION OF THE PREFERRED EMBODIMENTS

Based on the accompanying drawings, the following describes an exemplary embodiment to embody the present invention.

Figure 1:
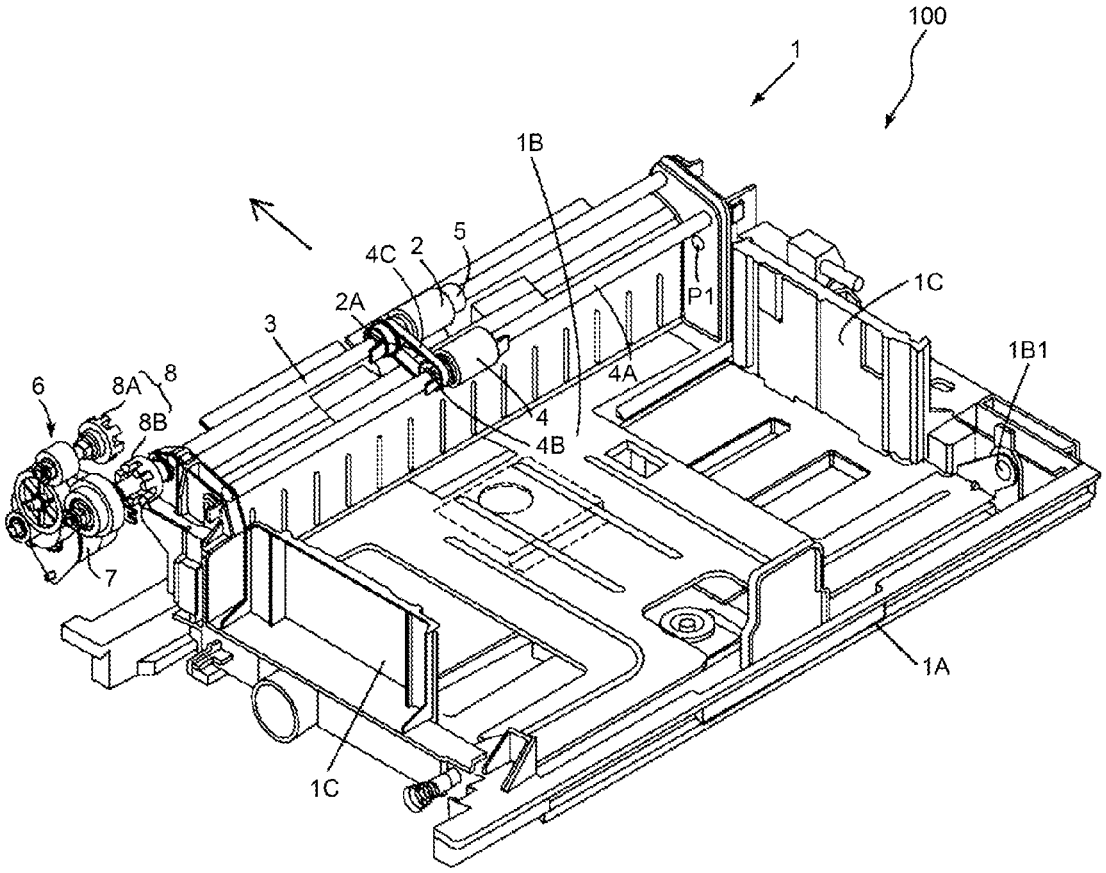
FIG. 1 is a perspective view for explaining the configuration of a relevant portion of a paper feeding device according to an embodiment of the present invention.

In FIG. 1, a paper feed tray 1 that can house paper as a recording medium used in a paper feeding device 100 is provided with a paper placing portion 1B as a liftable placing portion, inside a frame body 1A for which the upper surface is open.

Although the detail is not described, the paper placing portion 1B uses a configuration in which, with the upstream side in a delivery conveying direction of paper indicated by the arrow as a fulcrum (a portion indicated by the symbol 1B1 in FIG. 1), the downstream side in the delivery conveying direction swings up and down. Consequently, when the downstream side in the delivery conveying direction is lifted up, the paper can be brought into contact with a paper feeding roller 2 which will be described later.

The position of the liftable paper placing portion 1B in the up-and-down direction is configured to be detected by an upper limit sensor P1.

Specifically, the upper limit position of the paper placing portion 1B detected by the upper limit sensor P1 corresponds to a position at which the uppermost paper loaded can be brought into contact with the above-described paper feeding roller 2, for example.

The paper feed tray 1 is provided with side fences 1C that align the end edges of the paper loaded on the paper placing portion 1B in the width direction thereof, and are in a state of being movable in the width direction.

Figure 9:
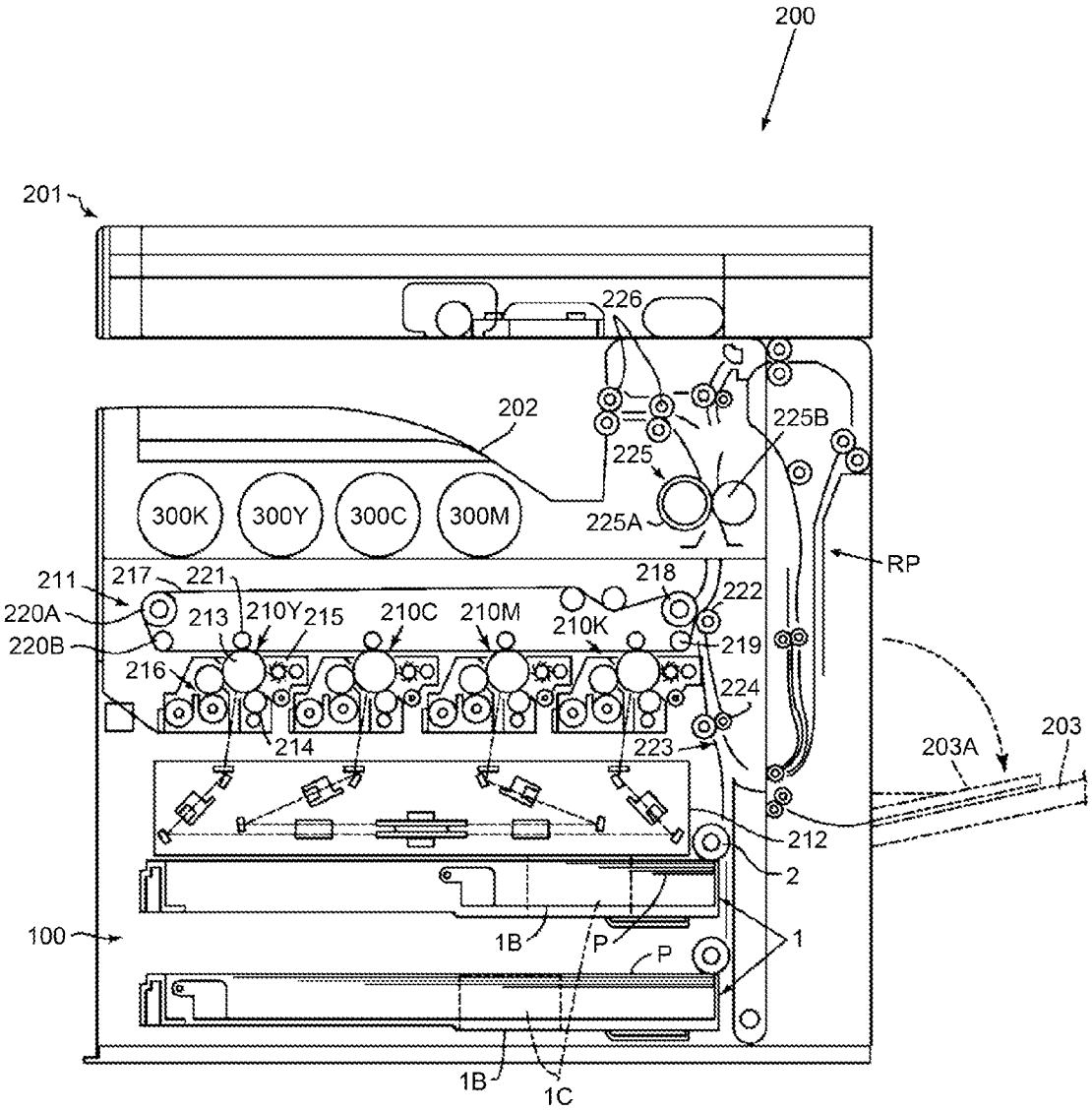
FIG. 9 is a schematic diagram illustrating the cross-section of a relevant portion of the image forming apparatus illustrated in FIG. 8.

On the downstream side of the paper feed tray 1 in the delivery conveying direction of paper, disposed is the paper feeding roller 2 that rotates in a given direction for the delivery of the paper on the paper placing portion 1B in a set state in which the paper feed tray 1 occupies a given position with respect to the body of an image forming apparatus 200 (see FIG. 9).

In the configuration illustrated in FIG. 1, a pickup roller 4 is disposed near the paper feeding roller 2.

The paper feeding roller 2 and the pickup roller 4 are linked by a belt 4C that is stretched around pulleys 2A and 4B which are attached to rotating shafts 3 and 4A of the respective rollers.

The paper feed tray 1 is a member that is movable and removable with respect to the body of the image forming apparatus 200 illustrated in FIG. 8, and is provided with a drive transmission mechanism 6 that performs drive transmission from a later-described driving source to the paper feeding roller 2.

Figure 2:
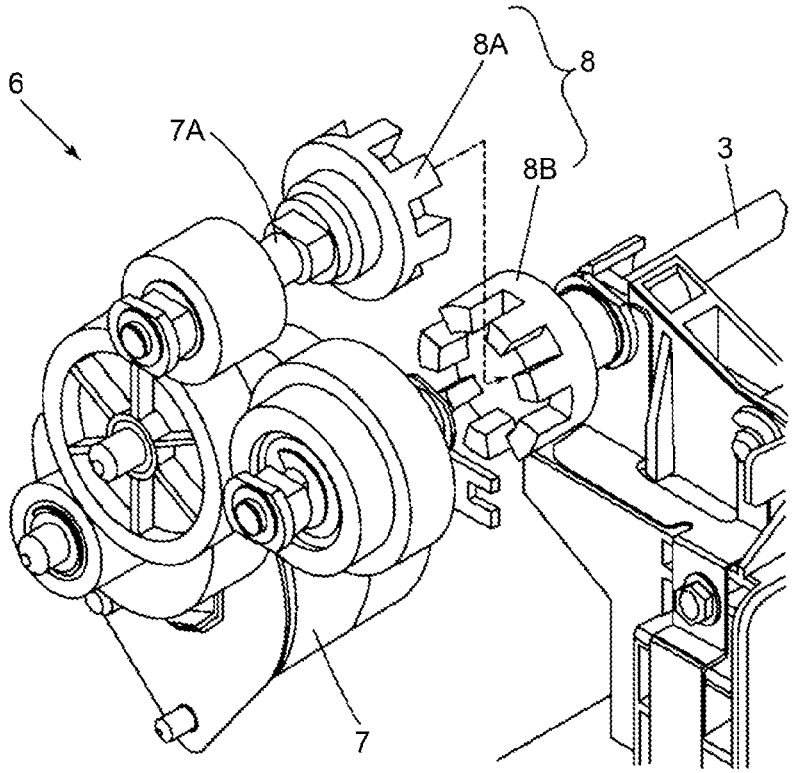
FIG. 2 is a perspective view illustrating the configuration of a fitting portion used in the configuration of the relevant portion illustrated in FIG. 1.

As illustrated in FIG. 2, the drive transmission mechanism 6 includes a drive member 8A that is provided on the image forming apparatus body side and is driven to rotate by a conveying motor 7 that is a driving source and is rotatable forward and backward, and a driven member 8B provided on the paper feed tray 1 side. The drive member 8A is provided on an end portion of the output shaft of the conveying motor 7 in an integrated manner.

The driven member 8B is provided on an end portion of the rotating shaft 3 of the paper feed tray 1 in an integrated manner, forms a contacting state by contacting the drive member 8A when the paper feed tray 1 is set into the set state, and forms a coupling state in which the paper feeding roller 2 is rotated in the given direction when the driven member 8B is coupled to the drive member 8A.

The drive transmission mechanism 6 includes, on the rotating shaft 3, a one-way clutch 5 that transmits the driving force of the conveying motor 7 to the paper feeding roller 2 only when the driving force is a force in a forward direction that rotates the paper feeding roller 2 in the given direction. Consequently, when the rotating shaft 3 rotates backward, the rotation to the paper feeding roller 2 is not transmitted and thus the paper feeding roller 2 remains stopped. When the drive member 8A and the driven member 8B are coupled to each other, they form a fitting portion 8 by the teeth thereof meshing with each other as in a dog clutch.

Although illustration is omitted, the driven member 8B is biased in a fitting direction toward the drive member 8A located on the conveying motor 7 side so as to form the coupling state quickly.

Note that, although the detail is not described, the drive to a transmission shaft 7A is transmitted via a deceleration mechanism that decelerates the torque of the conveying motor 7.

The drive member 8A has a plurality of projecting portions along the circumferential direction thereof, the driven member 8B includes recessed grooves to which the projecting portions can fit in the circumferential direction, and thus the drive member 8A and the driven member 8B are configured in what is called a dog-clutch manner.

In the drive transmission mechanism 6, after the paper feed tray 1 is set into the set state and before a paper-feeding start command is output, that is, a delivery instruction is output, the conveying motor 7 is rotated to perform relative rotation between the drive member 8A and the driven member 8B in the contacting state, and the coupling state of the members 8A and 8B is formed.

Consequently, the drive from the conveying motor 7 that is a driving source is transmitted to the rotating shaft 3, and the paper feeding roller 2 rotates via the one-way clutch 5.

While the phases of the projecting portions of the drive member 8A and the recessed grooves of the driven member 8B are in agreement with each other, when the paper feed tray 1 is set into the set state, the formation of the contacting state of the drive member 8A and the driven member 8B together with the formation of the coupling state thereof are performed by using the bias on the driven member 8B side.

Figure 3:
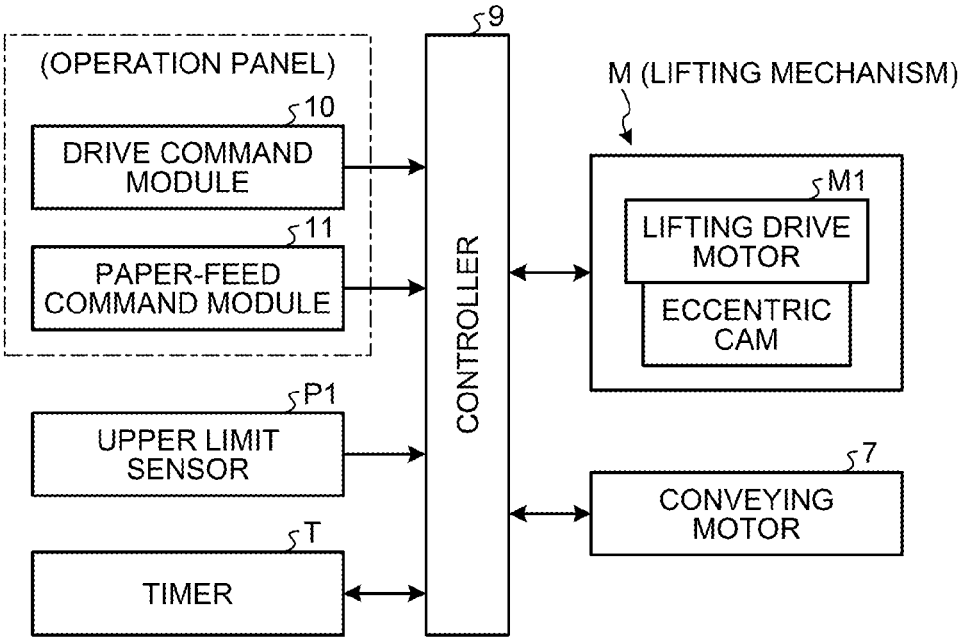
FIG. 3 is a block diagram for explaining the configuration of a controller used in the paper feeding device illustrated in FIG. 1.

The formation of the coupling state is achieved by a controller 9 illustrated in FIG. 3.

In FIG. 3, the controller 9 is used as a controller that performs drive control of driving sources of the conveying motor 7 and others. The controller 9 controls the rotation of the conveying motor 7 on condition of power-on or the set state of the paper feed tray 1.

As illustrated in FIG. 3, on the input side of the controller 9, a drive command module 10, a paper-feed command module 11, the upper limit sensor P1, and a timer T are connected. On the output side of the controller 9, connected are a drive module for the conveying motor 7 that is a driving source and a drive module for a lifting drive motor M1 used for a lifting mechanism M of the paper placing portion 1B which will be described later. Note that, in FIG. 3, only the conveying motor 7 and the lifting drive motor M1 are indicated and driver circuit modules used as a drive module that transforms a control signal into a drive signal and outputs it are omitted.

The drive command module 10 is an instructing module that starts the drive of the conveying motor 7, and a power-up switch is used, for example. The paper-feed command module 11 is an instructing module that instructs the delivery of paper by starting the rotation of the paper feeding roller 2, and a print start switch is used, for example. The drive command module 10 and the paper-feed command module 11 are mounted and used on an operation panel, for example.

The lifting drive motor M1 connected to the output side of the controller 9 is a motor for lifting the downstream side of the paper placing portion 1B in the delivery conveying direction of paper, and is used to drive an eccentric cam (not depicted) that faces the undersurface of the paper placing portion 1B, for example.

The eccentric cam has a cam profile that pushes up the paper placing portion 1B toward the upper limit position at which the paper loaded on the paper placing portion 1B is brought into contact with the paper feeding roller 2 and sets a non-upper limit position at which the contact of the paper with the paper feeding roller 2 is released by lowering a given amount from the upper limit position. The lifting drive motor M1 and the eccentric cam in the foregoing are provided in the lifting mechanism M (see FIG. 3) that forms an upper limit state in which the uppermost paper out of the paper placed on the paper placing portion 1B is brought into contact with the paper feeding roller 2.

The controller 9 performs the above-described relative rotation on condition of power-on or the set state of the paper feed tray 1, thereby forming the coupling state between the drive member 8A and the driven member 8B before a paper delivery instruction is output. The delivery of paper is performed on condition of the execution of relative rotation and the delivery instruction.

Specifically, the following procedures are performed:

(1) When the paper feed tray 1 is removed and inserted after power-on, the conveying motor 7 is rotated to form the coupling state between the drive member 8A and the driven member 8B in the fitting portion 8 before a signal input from the paper-feed command module 11, and then a signal input of delivery instruction from the paper-feed command module 11 is waited for.

(2) When the paper placing portion 1B is determined to be in the upper limit state by the upper limit sensor P1 at the time of power-on, the relative rotation is performed while the upper limit state of the paper placing portion 1B is eliminated, and the coupling state is formed, and then the process described in the procedure (1) is performed.

(3) When the paper placing portion 1B is determined to be at the upper limit position at the time of power-on or at the time of reattaching the paper feed tray after power-on, the conveying motor 7 is rotated backward while the paper placing portion 1B remains in the same state, and then the process described in the procedure (1) is performed.

In the above procedures, a prerequisite is to set the fitting state, that is, the coupling state, between the members 8A and 8B in the fitting portion 8 before a signal input of delivery instruction from the paper-feed command module 11.

As a method of receiving a paper feed command after the setting of the coupling state is completed, the following method is conceivable:

For example, it is a method in which, by using a member that can be lit for a copy start switch used in the paper-feed command module 11, the switch is lit after the elapse of a given time for each processing time until the completion of the setting of the fitting state. Consequently, an operator can, by recognizing the lit state of the copy start switch, perform a switch operation.

Meanwhile, in the controller 9, the coupling state between the drive member 8A and the driven member 8B in the fitting portion 8 immediately after power-on is determined. This is performed to eliminate the disadvantage in which the coupling state of the fitting portion 8 of the paper feed tray 1 before power-on is not determinable at the time of power-on.

More specifically, when the power supply is turned off while the drive member 8A and the driven member 8B in the fitting portion 8 are in the coupling state, it is not necessary to purposely perform the relative rotation to set the fitting portion 8 into the coupling state. In contrast, when the paper feed tray 1 is removed and then inserted while the power supply is off, the fitting portion 8 may not be set in the coupling state. In this case, the operation to perform the relative rotation is necessary to set the fitting portion 8 into the coupling state.

Consequently, in the controller 9, by determining the position of the paper placing portion 1B at the time of power-on (power-up), it is determined whether or not the operation to set the fitting portion 8 into the coupling state is necessary.

It is assumed here that the time when the paper placing portion 1B is at the upper limit position is the time when the meshing phases of the drive member 8A and the driven member 8B in the fitting portion 8 are in agreement with each other. That is, when in the coupling state, the driven member 8B is biased toward the drive member 8A and they are in a meshing state, and the paper placing portion 1B is set at a position in which the delivery of paper by the paper feeding roller 2 can be performed. The time when the paper placing portion 1B is not at the upper limit position corresponds to a state in which the uppermost paper of the paper placing portion 1B is not in contact with the paper feeding roller 2.

Figure 4:
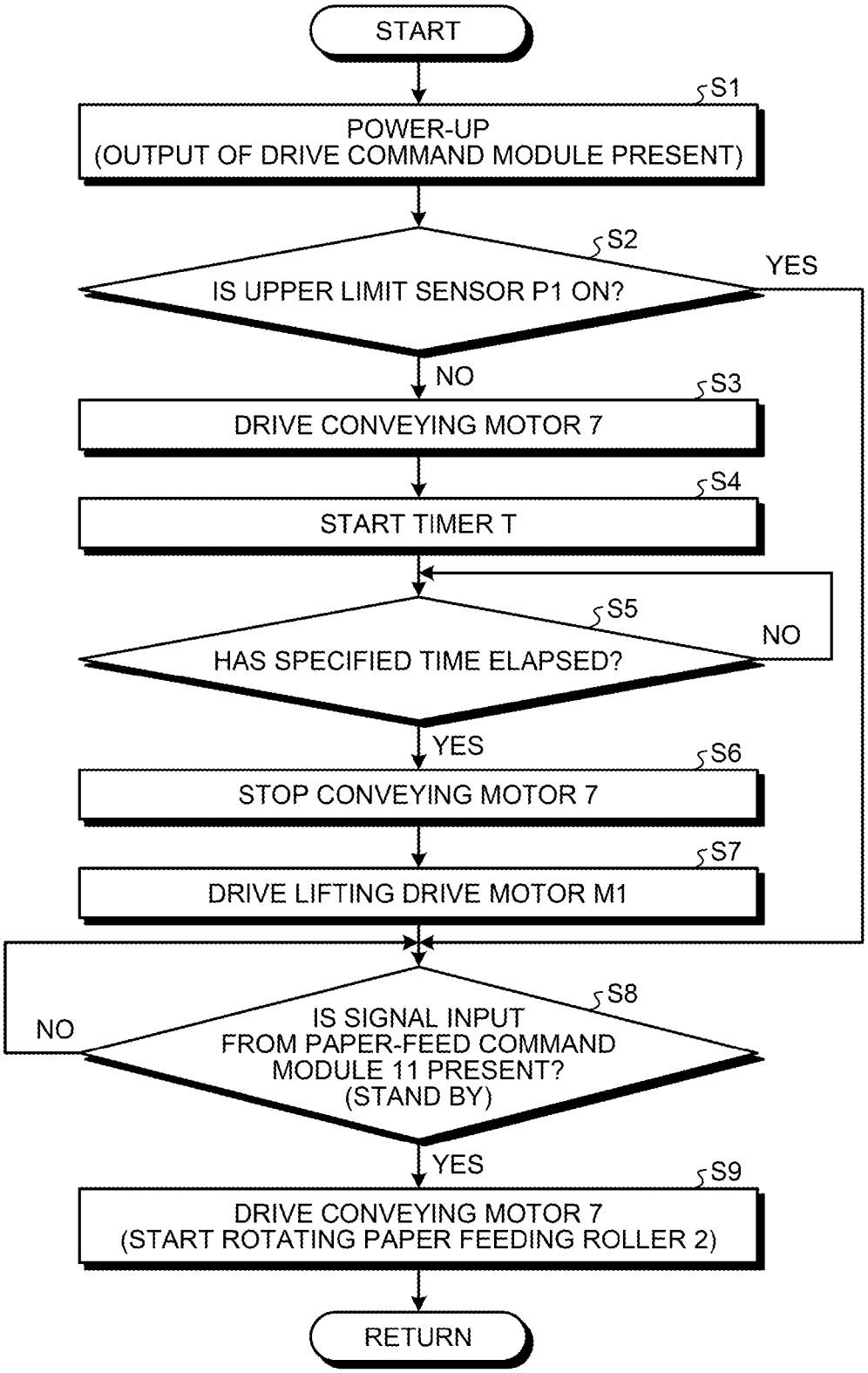

The above-described processing follows the flowchart illustrated in FIG. 4.

In FIG. 4, at the time of power-on (power-up), the determination of the upper limit position of the paper placing portion 1B is performed (S1, S2).

At Step S2, if the paper placing portion 1B is determined to be at the upper limit position that is the set state, it is regarded as the coupling state between the drive member 8A and the driven member 8B in the fitting portion 8 is formed, and the processing moves on to the process of standing by for a signal input of delivery instruction from the paper-feed command module 11 (S8).

In contrast, if the paper placing portion 1B is determined to be not at the upper limit position at Step S2, the process to form the coupling state between the drive member 8A and the driven member 8B is performed. More specifically, in the process to form the coupling state, the conveying motor 7 is driven, and at the same time as the start of driving, the timer T is started up to time the drive time (S3, S4).

In the process at Step S3 and Step S4, the relative rotation between the drive member 8A and the driven member 8B in the fitting portion 8 is performed to form the coupling state thereof. The coupling state means that the phases of the projecting portions of the drive member 8A and the recessed grooves of the driven member 8B being meshed with each other are made to agree.

As for the drive time of the conveying motor 7 to set the coupling state, the time equivalent to one rotation is used, for example. In the course of rotation, the meshing phases of the drive member 8A and the driven member 8B agree, and then they are coupled.

It is determined whether or not a specified time has elapsed for the drive of the conveying motor 7 (S5), and assuming that the coupling state between the drive member 8A and the driven member 8B has been formed within that time, the conveying motor 7 is stopped (S6).

Then, to lift the lowered paper placing portion 1B toward the upper limit position, the lifting drive motor M1 is driven (S7).

Although not indicated in FIG. 4, the drive of the lifting drive motor M1 is continued up until the paper placing portion 1B is detected by the upper limit sensor P1.

When the foregoing process is completed, the processing stands by for a signal input of delivery instruction from the paper-feed command module 11 (S8).

If there is a signal input of delivery instruction present from the paper-feed command module 11 at Step S8, the conveying motor 7 is rotated in a given direction in which the delivery of paper can be performed, and the drive transmission to the paper feeding roller 2 is performed via the fitting portion 8 (S9).

By the foregoing process, whether or not the operation of forming the coupling state is necessary is determined at the time of power-up, and when the operation to form the coupling state is necessary, the fitting portion 8 is set into the coupling state.

When there is a signal input from the paper-feed command module 11 present after the coupling state between the drive member 8A and the driven member 8B in the fitting portion 8 is formed, the paper feeding roller 2 can be rotated at substantially the same time as the paper-feeding start command is output.

As in the foregoing, no time lag between the time at which the paper-feeding start command is output and the rotation start of the paper feeding roller is made at the time of delivery instruction, which can prevent the occurrence of errors in paper jam detection using paper conveyance time based on the time of outputting the paper-feeding start command and using paper detection timing. Furthermore, prevented can be a paper jam that occurs when a given conveyance interval is not obtainable between the paper being delivered in a state of having a time lag and the paper that follows.

Next, the procedures (1) to (3) listed above will be described with reference to FIGS. 5 to 7. Note that, in FIGS. 5 to 7, the processes the same as those used in FIG. 4 are represented by the same symbols as those.

Figure 5:
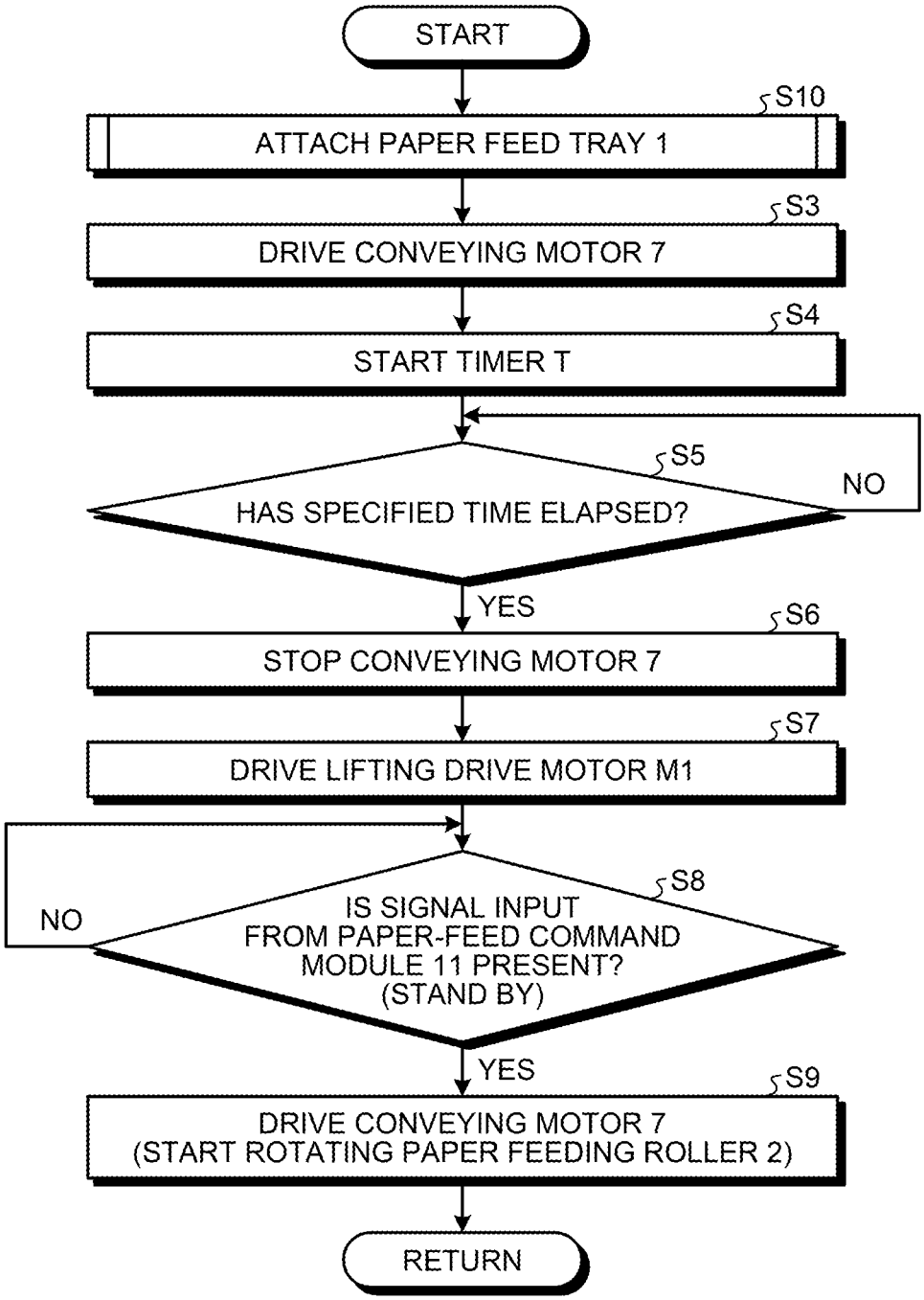

FIG. 5 illustrates the procedure listed in procedure (1). In FIG. 5, when the paper feed tray 1 is removed and attached again while in power-up (the apparatus is in operation) for paper replenishment or maintenance and inspection (S10), the conveying motor 7 is driven (S3). In the paper feed tray 1 at the stage of being attached to the body of the image forming apparatus 200, the paper placing portion 1B is in a state of being lowered, and thus it can be assumed that the paper placing portion 1B is not in the upper limit state without performing the detection by the upper limit sensor P1.

When the conveying motor 7 is driven, the drive time thereof is timed by the timer T, and at the time a specified time has elapsed, the conveying motor 7 is stopped (S4 to S6).

By the conveying motor 7 being driven, as the same as that illustrated in FIG. 4, the coupling state between the drive member 8A and the driven member 8B in the fitting portion 8 is assumed to be formed, and thus the lifting drive motor M1 is driven, thereby the paper placing portion 1B is lifted toward the upper limit position and is set into the set state (S7).

When it is determined that the paper placing portion 1B has reached the upper limit position by a signal input from the upper limit sensor P1, the processing stands by for a signal input from the paper-feed command module 11 (S8). Subsequently, in response to the signal input, the conveying motor 7 is driven forward, thereby rotating the paper feeding roller 2 in the given direction for delivering paper (S9).

The foregoing process is performed before the signal input of delivery instruction from the paper-feed command module 11, and therefore the meshing phases of the drive member 8A and the driven member 8B after the paper feed tray 1 is attached can be prevented from being left displaced and being in a non-coupling state.

As a result, because a time lag between the time at which the paper-feeding start command is output and the rotation start of the paper feeding roller 2 can be eliminated, the discrepancy in conveyance interval of paper is eliminated and the discrepancy in detection timing between the conveyance start time and the leading edge of paper is eliminated, whereby the occurrence of paper jam and the occurrence of false detection can be prevented.

Next, the procedure listed in procedure (2) will be described.

Figure 6:
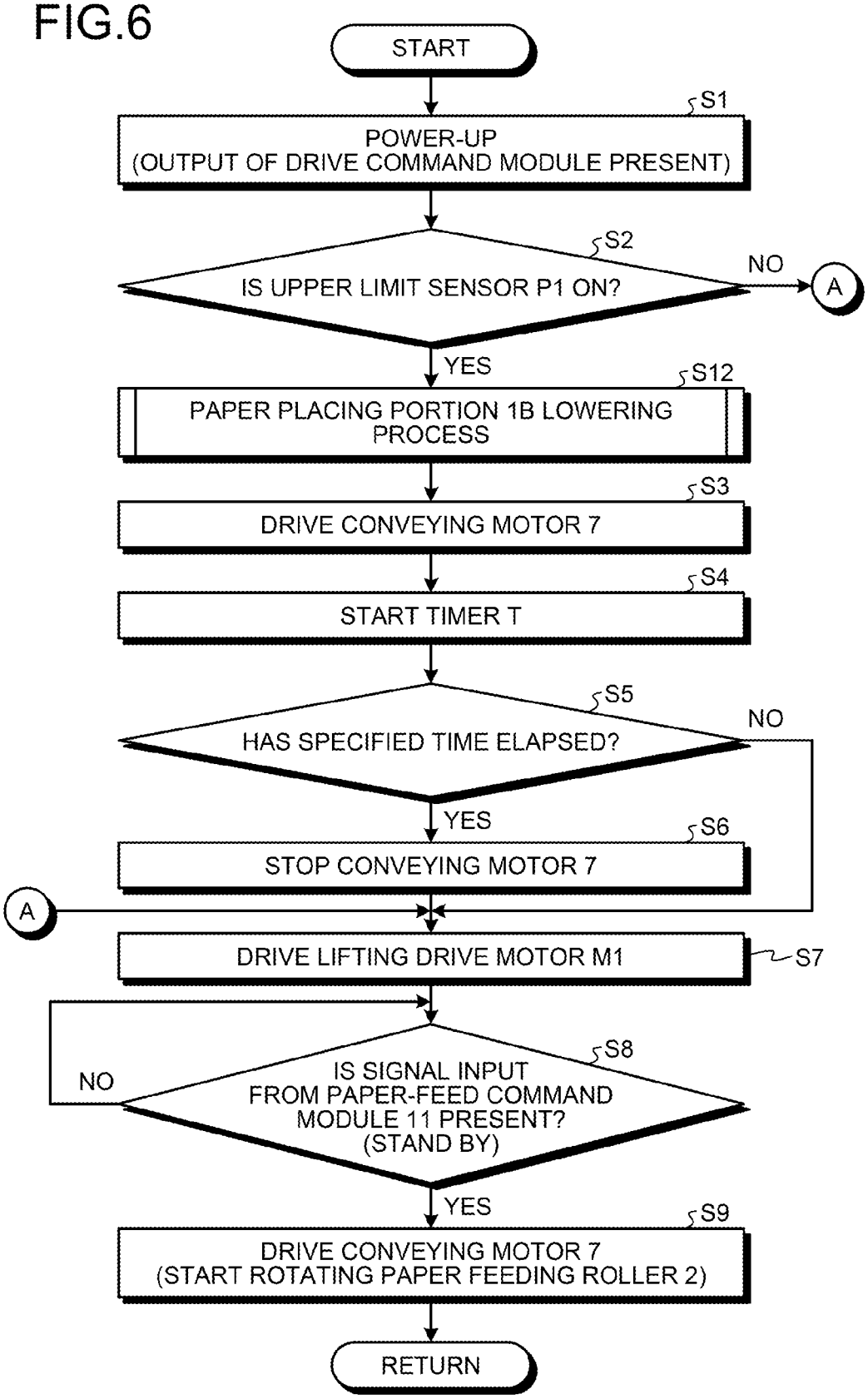

In FIG. 6, at the time of power-on (power-up), the determination of the upper limit position of the paper placing portion 1B is performed (S1, S2).

When the paper placing portion 1B is determined to be at the position of the upper limit state, a lowering process is performed by using the lifting mechanism (S12), and the upper limit state is eliminated. The lowering process of the paper placing portion 1B is made possible by driving the lifting drive motor M1 to rotate the eccentric cam, and thereby lowering the paper placing portion 1B from the upper limit position to an off position in accordance with the cam profile. The lowering amount is defined as the moving amount that corresponds to the time until the detection of the paper placing portion 1B by the upper limit sensor P1 is released.

Consequently, the paper in the paper placing portion 1B is separated so as not to contact the paper feeding roller 2, and even if the drive member 8A and the driven member 8B in the fitting portion 8 are rotated in the coupling state, the delivery of paper is not performed.

When the lowering process of the paper placing portion 1B is completed at Step S12, as the same as the procedure in the procedure (1), the coupling operation between the drive member 8A and the driven member 8B in the fitting portion 8 is performed by driving the conveying motor 7 (S3 to S6).

When the coupling operation is completed, the paper placing portion 1B is lifted by driving the lifting drive motor M1 and the processing stands by for a signal input of delivery instruction from the paper-feed command module 11. When a delivery instruction is output, the conveying motor 7 is driven forward, thereby rotating the paper feeding roller 2 in the given direction for delivering paper (S7 to S9).

Consequently, because the paper placing portion 1B is lifted to the position to bring the uppermost paper into contact with the paper feeding roller 2, when the paper feeding roller 2 rotates in conjunction with the forward driving of the conveying motor 7, the paper can be delivered. Note that, when it is determined that the paper placing portion 1B is not in the upper limit state at Step S2, the lifting operation of the paper placing portion 1B is performed after waiting for the completion of the alignment operation of meshing phases.

In this procedure also, the processing waits for a delivery instruction after performing the lowering process of the paper placing portion 1B and after performing the coupling operation between the drive member 8A and the driven member 8B in the fitting portion 8, and therefore the rotation of the paper feeding roller 2 is started at the same time as the delivery instruction. Consequently, because a time lag is not produced between the delivery instruction and the rotation start of the paper feeding roller 2, as the same as the procedure illustrated in FIG. 5, the occurrence of false detection and paper jam can be prevented.

Next, the procedure listed in procedure (3) will be described.

The procedure in this case targets when the coupling operation between the drive member 8A and the driven member 8B is performed while the paper placing portion 1B remains at the upper limit position, for example.

More specifically, it is intended for the case in which the eccentric cam that lifts the paper placing portion 1B is left stopped in a state to set the paper placing portion 1B at the upper limit position for some reason, or in which the paper placing portion 1B is lifted by using biasing means such as an elastic body without using the lifting drive motor M1. In this case, the above-described procedure (3) is performed as illustrated in FIG. 7.

Figure 7:
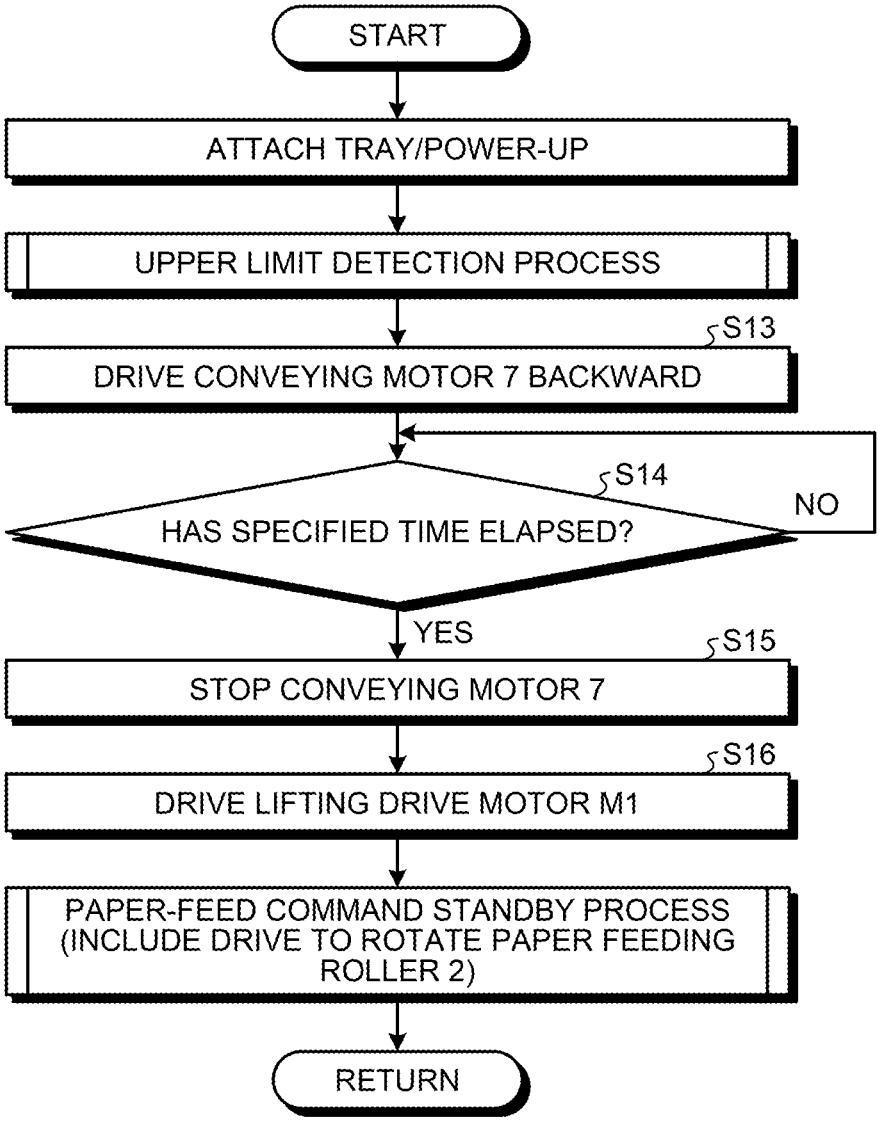
FIG. 7 is a flowchart for explaining the operation concerning the setting of the fitting state of the fitting portion performed by the controller illustrated in FIG. 3 when the paper placing portion is near the upper limit position at the time of power-on or reattaching the paper feed tray.

In FIG. 7, at the time of attaching the paper feed tray 1 or when the power is turned on, although not depicted, it is determined whether or not the paper placing portion 1B is at the upper limit position.

When the paper placing portion 1B is determined to be at the upper limit position at which the paper is in contact with the paper feeding roller 2 by the signal from the upper limit sensor P1, before a signal input of delivery instruction from the paper-feed command module 11, the conveying motor 7 is started to rotate backward for a specified time that is timed by the timer T (S13).

When the conveying motor 7 rotates backward, the driving force is not transmitted to the paper feeding roller 2 from the one-way clutch 5 that transmits only the force in the forward direction which rotates the paper feeding roller 2 in the given direction, and thus the relative rotation of the drive member 8A and the driven member 8B is performed by using the forces in the forward direction and the backward direction.

Note that, in FIG. 7, the process to determine the set state of the paper placing portion 1B is indicated by the step represented as "upper limit detection process".

It is determined whether or not the backward rotation time of the conveying motor 7 has passed the specified time (S14), and when it is determined that the specified time has elapsed, the backward rotation of the conveying motor 7 is stopped (S15).

In backward rotation of the conveying motor 7, the coupling state is formed when the meshing phases agree by the relative rotation between the drive member 8A and the driven member 8B in the fitting portion 8 in the course of backward rotation. At this time, although the rotation of the conveying motor 7 is transmitted to the paper feeding roller 2, the transmission of drive is blocked off by the one-way clutch 5 mounted on the rotating shaft 3 of the paper feeding roller 2.

Consequently, when the drive member 8A and the driven member 8B in the fitting portion 8 are in a state of being coupled making the meshing phases thereof agree, because the paper feeding roller 2 does not rotate, the leading edge of paper never moves in a direction opposite to the delivery direction. This can prevent the position of the leading end of paper from being displaced from a given position.

When the backward rotation of the conveying motor 7 is stopped, the paper placing portion 1B is lifted to the position detected by the upper limit sensor P1 (S16). On the occasion of this lifting, it is performed so as to ensure that the paper placing portion 1B is set at the position that is detected by the upper limit sensor P1.

When the foregoing process is completed, as the same as those described with reference to FIGS. 4 to 6, the processing stands by for a signal input of delivery instruction from the paper-feed command module 11, and in response to the signal input, rotates the conveying motor 7 forward to rotate the paper feeding roller 2 in the given direction in which the delivery of paper is performed. Note that, in FIG. 7, the content of this process is indicated by the step represented as "paper-feed command standby process".

In this procedure, by rotating the conveying motor 7 backward, the leading end of paper is never delivered unintentionally and the drive transmission to the paper feeding roller 2 is cut off by using the one-way clutch 5 at the time of backward rotation, and thus the paper can be prevented from moving in the direction opposite to the delivery direction.

Consequently, by setting the coupling state by making the meshing phases of the fitting members 8A and 8B in the fitting portion 8 agree, no time lag is produced between the time at which the paper feed command is output and the rotation start time of the paper feeding roller 2, and the displacement of the position of the leading end of paper that occurs when the coupling state is set can be eliminated.

As a result, the conveying state detection that targets the position of the leading end of paper can be performed without an error and the conveyance interval can also be made appropriate so as to prevent the occurrence of paper jam or the like.

Next, described is an image forming apparatus that uses the above-described paper feeding device 100.

Figure 8:
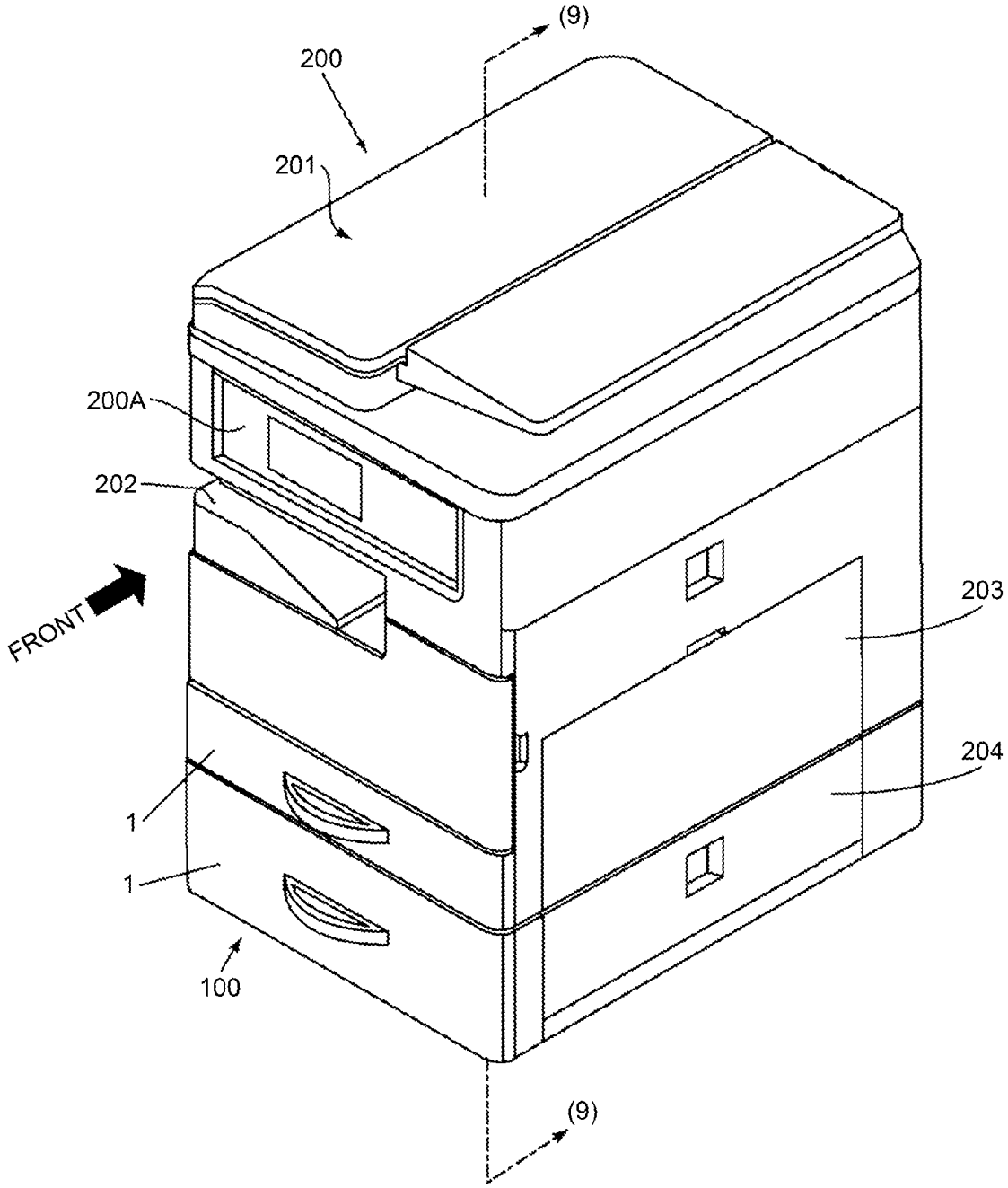
FIG. 8 is an external view of an image forming apparatus in which the paper feeding device in the embodiment is used.

In FIG. 8, the image forming apparatus 200 is a color printer provided with a plurality of image formation devices 210Y, 210C, 210M, and 210K illustrated in FIG. 9. However, the invention is not limited to color printers and includes facsimile devices and printing machines.

In the image forming apparatus 200, across the image formation devices 210Y, 210C, 210M, and 210K in the vertical direction illustrated in FIG. 9, a document scanning device 201 is disposed at the upper portion of the body, and the paper feeding device 100 provided with a plurality of paper feed trays 1 that have the configuration described with reference to FIG. 1 is disposed at the lower portion of the body.

Beneath the document scanning device 201, a discharge tray 202 that forms an in-body discharging unit is provided making a space unnecessary for paper ejection to the outside of the apparatus. At the position close to the document scanning device 201 and on the front side facing the paper feed tray 1, operation panel 200A is provided.

On the side surface of the image forming apparatus 200, covers 203 and 204 openable with respect to the apparatus body are provided, and can be opened at the time of replacing or maintaining built-in units of the image formation unit, or at the time of taking out the paper that caused a paper jam in a conveying path. One of the openable covers 203 is a member that is also opened at the time of manual paper feed, and as represented by the symbol 203A in FIG. 9, is provided with side fences that regulate the end edges of the manually fed paper in the width direction.

FIG. 9 is a schematic diagram for explaining the relevant portion of the image forming apparatus 200 represented in the direction of arrows (9) in FIG. 8.

In FIG. 9, inside the image forming apparatus 200, the image formation devices 210Y (yellow), 210C (cyan), 210M (magenta), and 210K (black) for four colors are juxtaposed, and above the respective image formation devices, a transfer device 211 is disposed in a state of facing thereto.

Beneath the respective image formation devices 210Y, 210C, 210M, and 210K, an optical unit 212 as a writing unit that can emit laser light is disposed, and below the optical unit 212, the paper feed trays 1 provided on the paper feeding device 100 are disposed.

The construction of the respective image formation devices 210Y, 210C, 210M, and 210K is the same, and with the image formation device 210Y as an example, the device includes the following members.

A photoconductor drum 213 as an image bearer is housed in a unit as a whole together with a charging device 214 that charges the photoconductor drum 213 and a cleaning device 215 that removes developer and others which remained on the photoconductor drum 213 as processing means that act on the photoconductor drum 213. Furthermore, inside the unit, a developing device 216 that develops a latent image formed on the photoconductor drum 213 is also housed. The unit is provided in each of the image formation devices 210Y, 210C, 210M, and 210K, and is detachable with respect to the apparatus body by opening an openable cover (not depicted) located in the front of the apparatus body.

Meanwhile, the transfer device 211 is provided with a transfer belt 217 that is an endless rotating member, and four rollers 218, 219, 220A, and 220B that rotatably support the transfer belt 217. The transfer device 211 is further provided with a primary transfer roller 221 to transfer toner images formed on the respective photoconductor drums 213 onto the transfer belt 217, and a secondary transfer roller 222 to further transfer the toner images that are transferred on the transfer belt 217 onto paper P.

The paper feed tray 1 is provided with the paper feeding roller 2 that feeds the uppermost paper P out of the paper P as recording media loaded on the paper placing portion 1B (for convenience, the pickup roller 4 depicted in FIG. 1 is omitted). The paper P delivered from the paper feed tray 1 is fed toward a registration roller 224 disposed on a conveying path 223, and after registration timing is set, is conveyed toward the position of the secondary transfer roller 222. The registration roller 224 is provided at a position at which the registration timing is determined targeting either of the paper P delivered from the paper feed tray 1 in the conveying path 223 and the paper introduced from the openable cover 203 side. Note that, in FIG. 9, the symbol RP represents a reverse conveying path in which the paper P is inverted and conveyed to the position of the registration roller 224 when dual-sided printing is performed. The reverse conveying path RP uses a configuration provided with a detour to which the trailing end of the paper P, a part of which is made to project toward the discharge tray 202, in the conveying direction is introduced to invert it.

Meanwhile, in the conveying path in which the paper P for which the secondary transfer was finished reaches the discharge tray 202, a fixing unit 225 is disposed. The fixing unit 225 employs a heat-roller fixing system that uses a fixing roller 225A that has a heat source and a pressure roller 225B that faces thereto.

The paper P for which the fixing was finished is conveyed either toward the discharge tray 202 or toward the reverse conveying path RP, by ejecting rollers 226 that can rotate forward and backward and are disposed between the fixing unit 225 and the discharge tray 202. The symbols 300K, 300Y, 300C, and 300M represent toner supply tanks that house toner to be supplied to the developing devices 216.

In the foregoing configuration, at the time of image formation, image forming process is performed on the photoconductor drums 213 of the respective image formation devices 210Y, 210C, 210M, and 210K, and the toner images formed on the photoconductor drums 213 are primary-transferred onto the transfer belt 217 of the transfer device 211 in sequence. The toner images transferred on the transfer belt 217 in a superimposed manner are collectively transferred, by the secondary transfer roller 222, onto the paper P fed either from the paper feed tray 1 or from the cover 203.

The paper P for which the collective transfer was finished is conveyed either to the discharge tray 202 or to the reverse conveying path RP, after the toner image is fixed by the fixing unit 225.

The image forming in a plurality of colors is performed when the respective image formation devices 210Y, 210C, 210M, and 210K are used. However, in the image forming apparatus 200, it is not limited to this image forming mode, and image forming by selecting a single color can also be performed.

In accordance with the embodiments of the present invention, the fitting state at the fitting portion is set before a paper-feeding start command is output, thereby enabling the delivery rotation of the paper feeding roller to be performed at the time the paper-feeding start command is output.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feeding device comprising:

a paper feed tray configured to move with respect to an image forming apparatus body and house a recording medium, the paper feed tray includes a liftable paper placing portion on which recording media are placed and a lifting mechanism configured to lift the paper placing portion within the paper feed tray;

a paper feeding roller configured to rotate in a given direction for a delivery of the recording medium housed in the paper feed tray in a set state in which the paper feed tray occupies a given position with respect to the image forming apparatus body;

a drive transmission mechanism configured to perform drive transmission from a driving source to the paper feeding roller, wherein:

the drive transmission mechanism includes a drive member that is provided on the image forming apparatus body side and is driven to rotate by the driving source so as to rotate the paper feeding roller in the given direction, and a driven member that is provided on the paper feed tray side, forms a contacting state by contacting the drive member when the paper feed tray is set into the set state, and forms a coupling state in which the driven member rotates the paper feed roller in the given direction when the driven member is coupled to the drive; and a controller configured to, after the paper feed tray is set into the set state and before a delivery instruction of the recording medium housed in the paper feed tray is output, rotate the driving source to perform relative rotation between the drive member and the driven member in the contacting state, and to further rotate the drive member and the driven member in the coupling state, wherein the controller is configured to determine a position of the paper placing portion within the paper feed tray based on an upper limit sensor, at the time of power-on, to determine whether to set the coupling state between the drive member and the driven member, the drive member has a plurality of projecting portions along a circumferential direction thereof, and the driven member includes recessed grooves to which the projecting portions can fit in the circumferential direction, and when the drive member and the driven member are coupled to each other, a fitting portion is formed via projecting portions of the drive member and recessed grooves of the driven member meshing together with each other.

2. The paper feeding device according to claim 1, wherein the controller is configured to control whether the coupling state is formed on condition of power-on or the set state by the relative rotation that controls rotation of the driving source before the instruction is output, and the delivery is performed on condition of the relative rotation having been performed and the instruction having been input to the controller.

3. The paper feeding device according to claim 1, wherein the lifting mechanism is configured to lift the paper placing portion to form an upper limit state in which an uppermost recording medium out of the recording media placed on the placing portion is brought into contact with the paper feeding roller, and the coupling state is formed while the relative rotation is performed in a state in which the upper limit state is eliminated.

4. The paper feeding device according to claim 1, further comprising a one-way clutch that transmits a driving force of the driving source to the paper feeding roller only when the driving force is a force in a forward direction that rotates the paper feeding roller in the given direction, wherein the coupling state is formed by the relative rotation made by making the driving force be a force in a direction opposite to the forward direction.

5. The paper feeding device according to claim 2, further comprising a one-way clutch that transmits a driving force of the driving source to the paper feeding roller only when the driving force is a force in a forward direction that rotates the paper feeding roller in the given direction, wherein the coupling state is formed by the relative rotation made by making the driving force be a force in a direction opposite to the forward direction.

6. An image forming apparatus that includes the paper feeding device according to claim 1.

7. The paper feeding device according to claim 1, wherein the drive transmission mechanism includes, on a rotating shaft, a one-way clutch that transmits the driving force of the driving source to the paper feeding roller when the driving force is a force in a forward direction that rotates the paper feeding roller in the given direction.

8. The paper feeding device according to claim 1, wherein the driven member is biased in a fitting direction toward the drive member so as to form the coupling state quickly.

9. The paper feeding device according to claim 1, wherein the controller is configured to determine the coupling state between the drive member and the driven member immediately after the power-on is operated.

10. A paper feeding device comprising:

a paper feed tray configured to move with respect to an image forming apparatus body and house a recording medium;

a paper feeding roller configured to rotate in a given direction for a delivery of the recording medium housed in the paper feed tray in a set state in which the paper feed tray occupies a given position with respect to the image forming apparatus body;

a drive transmission mechanism configured to perform drive transmission from a driving source to the paper feeding roller, wherein:

the drive transmission mechanism includes a drive member that is provided on the image forming apparatus body side and is driven to rotate by the driving source so as to rotate the paper feeding roller in the given direction, and a driven member that is provided on the paper feed tray side, forms a contacting state by contacting the drive member when the paper feed tray is set into the set state, and forms a coupling state in which the driven member rotates the paper feed roller in the given direction when the driven member is coupled to the drive; and a controller configured to, after the paper feed tray is set into the set state and before a delivery instruction of the recording medium housed in the paper feed tray is output, rotate the driving source to perform relative rotation between the drive member and the driven member in the contacting state, and to further rotate the drive member and the driven member in the coupling state;

a one-way clutch configured to transmit a driving force of the driving source to the paper feeding roller only when the driving force is a force in a forward direction that rotates the paper feeding roller in the given direction, wherein:

the coupling state is formed by the relative rotation made by making the driving force be a force in a direction opposite to the forward direction, the drive member has a plurality of projecting portions along a circumferential direction thereof, and the driven member includes recessed grooves to which the projecting portions can fit in the circumferential direction, and when the drive member and the driven member are coupled to each other, a fitting portion is formed via projecting portions of the drive member and recessed grooves of the driven member meshing together with each other.

11. The paper feeding device according to claim 10, wherein the controller is configured to control whether the coupling state is formed on condition of power-on or the set state by the relative rotation that controls rotation of the driving source before the instruction is output, and the delivery is performed on condition of the relative rotation having been performed and the instruction having been input to the controller.

12. The paper feeding device according to claim 10, wherein the paper feed tray includes a liftable placing portion on which recording media are placed, and a lifting mechanism that is configured to lift the placing portion and forms an upper limit state in which an uppermost recording medium out of the recording media placed on the placing portion is brought into contact with the paper feeding roller, and the coupling state is formed while the relative rotation is performed in a state in which the upper limit state is eliminated.

13. The paper feeding device according to claim 10, wherein the drive transmission mechanism includes, on a rotating shaft, a one-way clutch that transmits the driving force of the driving source to the paper feeding roller when the driving force is a force in a forward direction that rotates the paper feeding roller in the given direction.

14. The paper feeding device according to claim 10, wherein the driven member is biased in a fitting direction toward the drive member so as to form the coupling state quickly.

15. The paper feeding device according to claim 10, wherein the controller is configured to determine the coupling state between the drive member and the driven member immediately after the power-on is operated.

16. The paper feeding device according to claim 10, wherein the controller is configured to determine a position of a paper placing portion based on an upper limit sensor, at the time of power-on, to determine whether to set the coupling state between the drive member and the driven member based on an upper limit sensor.

17. An image forming apparatus that includes the paper feeding device according to claim 10.

* * * * *